US008230914B2

(12) United States Patent
Hallundbaek et al.

(10) Patent No.: US 8,230,914 B2
(45) Date of Patent: Jul. 31, 2012

(54) ANCHOR TOOL

(75) Inventors: Jørgen Hallundbaek, Graested (DK); Rasmus Sommer, Valby (DK)

(73) Assignee: Weltec A/S, Allerod (DK)

( * ) Notice: Subject to any disclaimer, the term of this patent is extended or adjusted under 35 U.S.C. 154(b) by 191 days.

(21) Appl. No.: 12/596,248

(22) PCT Filed: Apr. 24, 2008

(86) PCT No.: PCT/DK2008/000150

§ 371 (c)(1),
(2), (4) Date: Oct. 16, 2009

(87) PCT Pub. No.: WO2008/128542

PCT Pub. Date: Oct. 30, 2008

(65) Prior Publication Data

US 2011/0146970 A1 Jun. 23, 2011

(30) Foreign Application Priority Data

Apr. 24, 2007 (DK) ..... 2007 00597

(51) Int. Cl.
*E21B 23/00* (2006.01)

(52) U.S. Cl. ..... 166/212; 166/206; 166/208; 166/382; 175/81; 175/98; 175/99; 175/230

(58) Field of Classification Search ..... 166/212, 166/206, 203, 382; 175/4.52, 81, 98, 99, 175/230

See application file for complete search history.

(56) References Cited

U.S. PATENT DOCUMENTS

| | | | | |
|---|---|---|---|---|
| 2,612,346 | A | 9/1952 | Nelson | |
| 2,743,781 | A | 5/1956 | Lane | |
| 3,096,824 | A | 7/1963 | Brown | |
| 3,305,018 | A * | 2/1967 | White, Jr. et al. | 166/297 |
| 3,512,592 | A | 5/1970 | Kellner | |
| 3,859,851 | A | 1/1975 | Urbanosky | |
| 4,612,987 | A | 9/1986 | Cheek | |
| 2004/0154809 | A1 * | 8/2004 | Bakke | 166/382 |

FOREIGN PATENT DOCUMENTS

| | | |
|---|---|---|
| GB | 2382808 | 5/2003 |
| WO | WO2007/017046 | 2/2007 |

OTHER PUBLICATIONS

International Preliminary Report on Patentability prepared by WIPO dated Oct. 27, 2009.

* cited by examiner

*Primary Examiner* — Daniel P Stephenson
*Assistant Examiner* — Yong-Suk Ro
(74) *Attorney, Agent, or Firm* — Cozen O'Connor

(57) ABSTRACT

An anchor tool for anchoring a downhole tool within a casing, a well, or any other downhole, hollow space. The tool has a longitudinal tool body with a center axis extending through the tool body in the center of the body, a first recess, a second recess, a third recess, and a fourth recess in the tool body; and a first anchor, a second anchor, a third anchor, and a fourth anchor. The first anchor is provided in the first recess, and so forth, and the anchors are outwards movable in the recesses for anchoring the tool. Each anchor provided in the recesses extends through the tool body transverse to and across the center axis and the anchors and the corresponding recesses are situated in the tool body for providing a symmetrical anchoring of the anchor tool.

10 Claims, 6 Drawing Sheets

Prior Art

ANCHOR TOOL

PRIORITY CLAIM

This is a U.S. national stage of application No. PCT/DK2008/000150, filed on Apr. 24, 2008. Priority is claimed on the following application: Denmark Application No.: PA 200700597, Filed on Apr. 24, 2007, the content of which is incorporated here by reference.

TECHNICAL FIELD

The present invention relates to an anchor tool for anchoring a downhole tool within a casing, a well, or any other downhole cavity, comprising a longitudinal tool body with a centre axis extending through the tool body in the centre of the body, at least one recess in the tool body, and a first anchor provided in the recess and outwards movable in the recess for anchoring the tool.

BACKGROUND

Anchors are used for anchoring a downhole tool in the direction traverse to the longitudinal direction of the tool for resisting the torsional forces that the tool is subjected to during e.g. drilling.

A known solution is disclosed in U.S. Pat. No. 5,070,941, in which anchors anchor a tool by use of hydraulic. The anchors are placed in a recess in the circumference of the tool so as to be out of the way of the central elements of the tool placed in the centre of the tool. When anchoring the tool, the anchors are moved outwards, most of the anchor thus projecting from the side of the tool.

Since most of the anchor projects from the tool, the anchor will become somewhat tilted when exposed to the longitudinal force created when the tool is in use. In this way, each anchor is forced to be inclined in the recess in the tool and outwards towards the surrounding casing or the like. It is often seen that anchors get stuck in this inclined position, and therefore cannot be retracted into the tool again, when the anchors are forced to be tilted in the tool. As a result, the whole tool is stuck downhole.

Furthermore, in order to mount the anchor in a recess in the tool, the edge of the recess needs to be chamfered. When the anchor is mounted in the recess, the chamfering leaves a little slot in which dirt may be gathered. In addition, when the anchor is used for anchoring the tool and subsequently is retracted into the tool again, dirt in the well fluid is retracted into the little slot and further into the recess. In this way, the dirt may be the decisive factor for the anchor to get stuck.

DESCRIPTION OF THE INVENTION

An aspect of the present invention is, at least partly, to overcome the disadvantages of the downhole systems mentioned above, and to provide an improved anchor tool in a downhole tool system.

This aspect and the advantages becoming evident from the description below are obtained by an anchor tool for anchoring a downhole tool within a casing, a well, or any other downhole cavity, comprising:

- a longitudinal tool body with a centre axis extending through the tool body in the centre of the body,
- a first recess, a second recess, a third recess, and a fourth recess in the tool body, and
- a first anchor, a second anchor, a third anchor, and a fourth anchor, where the first anchor is provided in the first recess, and so forth, and the anchors are outwards movable in the recesses for anchoring the tool, wherein each anchor provided in the recesses extends through the tool body transverse to and across the centre axis, and wherein the anchors and the corresponding recesses are situated in the tool body for providing a symmetrical anchoring of the anchor tool as follows:

- the first anchor is positioned in the first recess and so as to move across the centre axis and out in one direction orthogonal to the centre axis,
- the second anchor is positioned in the second recess next to the first recess and so as to move across the centre axis and out in a second direction opposite and parallel to the first direction,
- the third anchor is positioned in the third recess next to the second recess and so as to move in the second direction,
- the fourth anchor is positioned in the fourth recess next to the third recess and so as to move in the first direction.

By having a symmetrically anchored tool, all the force provided for an operation can be used for that operation.

In one embodiment, the anchor may be movable by means of hydraulic.

Furthermore, each recess may on its inside be provided with a circumferential groove and at least one sealing means in the groove.

In addition, hydraulic fluid may be pumped into the recess for forcing the anchor to move out of the recess for anchoring the tool to its surroundings.

In another embodiment, each anchor may have a cavity with an opening and a retaining means fastened in the recess outside the anchor and extending through the opening into the cavity, and a resilient means may be provided within the cavity between an inside of the opening of the cavity and the retaining means and may be compressed during movement of the anchor out of the recess.

In yet another embodiment, the resilient means may be positioned around the retaining means.

In addition, the retaining means may have a rod extending though the resilient means, the rod at its one end being fastened to the recess and, at its other end, having a plate-shaped means for abutting against the resilient means.

Furthermore, the resilient means may be a helically spring or a disc spring.

According to the invention, the anchor may have an oval, elliptic, or round cross-section.

In addition, the anchor tool may further comprise a pump system with a piston movable within a piston housing for pumping fluid into the recess.

Finally, the invention also relates to the anchor mentioned above.

BRIEF DESCRIPTION OF THE DRAWINGS

The invention is explained in detail below with reference to the drawings, in which.

The drawings are merely schematic and shown for an illustrative purpose.

DETAILED DESCRIPTION OF THE INVENTION

Figure 2:
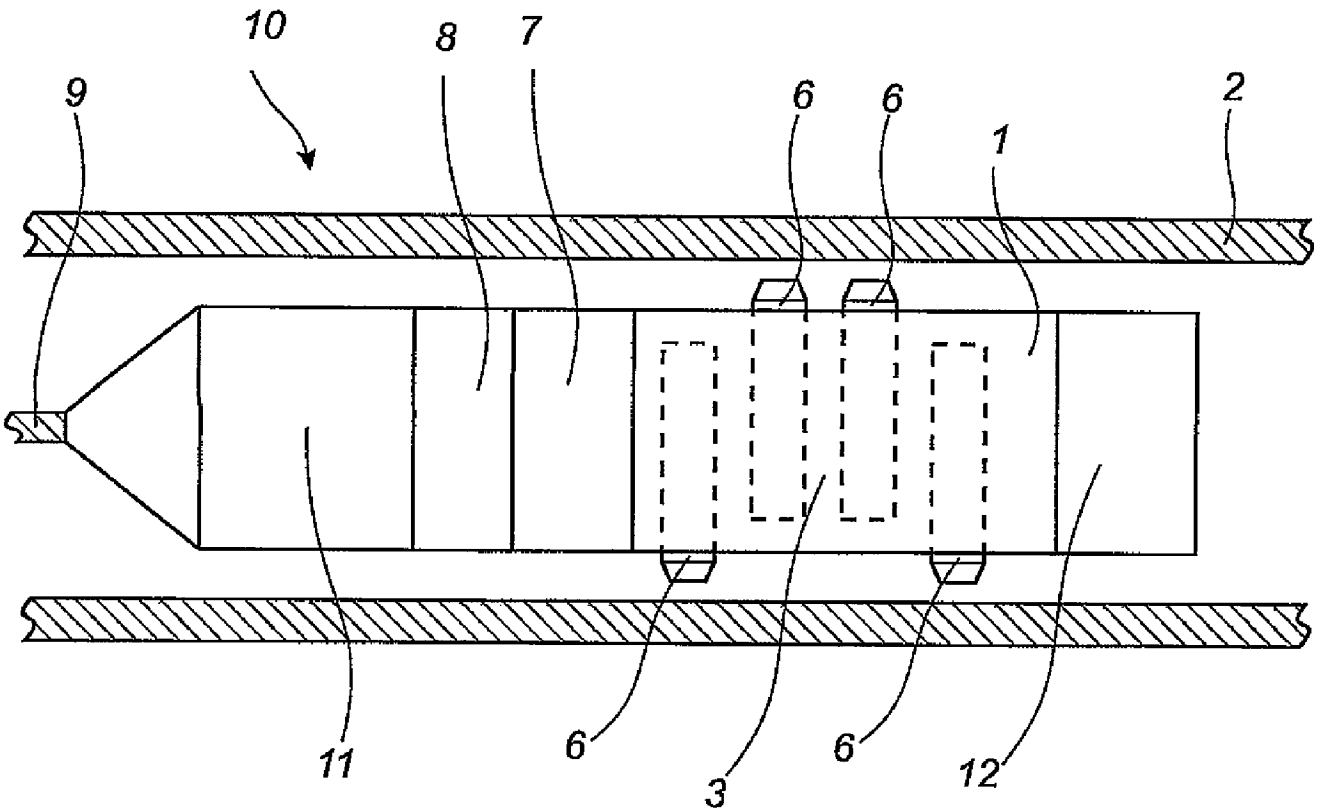
FIG. 2 shows an anchor tool according to the present invention.

In FIG. 2, an anchor tool 1 is shown. The anchor tool 1 is shown having four anchors 6 for anchoring the tool 1 subsurface, in e.g. a casing 2 or a formation. During the anchoring process, the anchors 6 are forced out of the tool 1 by means of hydraulic. In this way, fluid is pumped by a pump 7 into a recess 5 in which the anchor 6 is positioned in the tool 1 for forcing the anchor 6 out of the recess 5. The pump 7 is driven by a motor 8 which is powered through a wireline 9 from above surface.

The anchor tool is shown having a first anchor 6, a second anchor 6, a third anchor 6, and a fourth anchor 6. The anchors are provided in four recesses so that the first anchor is provided in the first recess, the second anchor is provided in the second recess, the third anchor is provided in the third recess, and the fourth anchor is provided in the fourth recess. The anchors are outwards movable in the recesses in a direction orthogonal to a centre axis extending through the centre of the tool. The anchors move outwards in order to anchor the tool.

Each anchor extends through the tool body transverse to and across the centre axis, but not all the way through the tool. In order to provide a stable anchoring of the tool, the anchors have to be placed symmetrically in the tool. As shown in FIG. 2, the first anchor is positioned to move across the centre axis and out in one direction orthogonal to the centre axis. The second anchor is positioned in the second recess next to the first recess so as to be able to move across the centre axis and out in a second direction opposite and parallel to the first direction. The third anchor is positioned in the third recess next to the second recess so as to be able to move across the centre axis in the second direction. Finally, the fourth anchor is positioned in the fourth recess next to the third recess so as to be able to move in the first direction. In this way, the anchors are placed symmetrically on each side of the tool.

If the anchor tool only had three anchors, two anchors on one side and one anchor on another side, the tool would be anchored so that the side having only one anchor would abut the wall of the casing, or the formation to which it was anchored. In this way, the tool would be positioned in one side of the casing or the formation, and the tool would thus not be able to operate in the centre of the casing or formation unless the tool was reconstructed asymmetrically. By having an asymmetrically constructed tool, the force provided during e.g. drilling would result in a tool out of balance demanding a high amount of force in order to compensate for the disequilibrium. Thus, force would be used inefficiently.

Therefore, the tool according to the present invention is more efficient than known solutions of prior art in that it anchors the tool symmetrically.

The tool system 10, shown in FIG. 2, is controlled by an electronic unit 11, and the system 10 can be used for anchoring different kinds of tools 12 such as a perforation tool, a fluid cleaner, a drilling tool, a packer element, a stroker, and the like tools.

Figure 3:
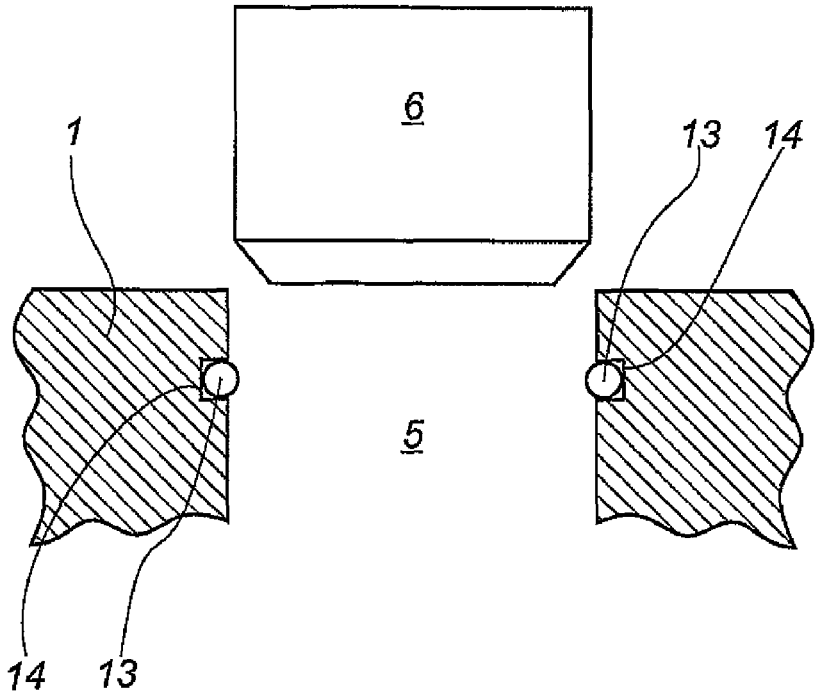
FIG. 3 shows a partial cross-sectional view of the anchor tool of the present invention.

In FIG. 3, a sectional view of a recess 5 is shown. The recess 5 is provided with a circumferential groove 14 in which a sealing means 13 in the form of a seal or packing ring, such as an O-ring 22, is provided. The anchor 6 has been chamfered so that the anchor 6 may easily be mounted in the recess 5.

By positioning the circumferential groove 14 with the sealing means 13 near the aperture of the recess, the anchor can move very far out of the recess without breaking the seal between the sealing means and the anchor.

Figure 1:
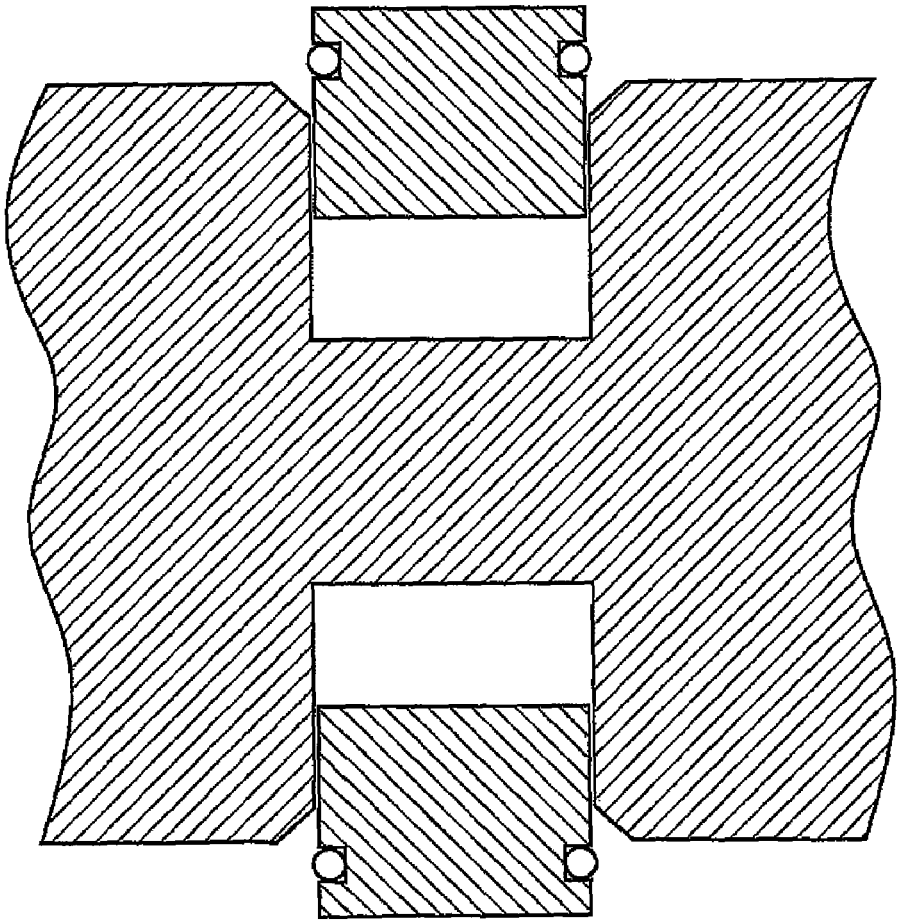
FIG. 1 shows a prior art anchor tool.

In known solutions, as shown in FIG. 1, the recess 5 is chamfered making a slot in the surface of the tool 1 when the anchor 6 is in its retracted position, which allows dirt to be deposited in the slot. Due to the round cross-sectional shape of the tool, the chamfering of the tool results in a substantial slot compared to the slot that would be the result if chamfering a plane surface. When the anchor 6 is retracted into the recess 5, the dirt is retracted along with it and thus enters into the space between the anchor 6 and the recess 5. Due to this, the known anchor 6 can get stuck in its projected position, the whole tool system 10 consequently getting stuck downhole.

By providing the sealing means 13 in a groove 14 in the recess 5, the edge of the recess 5 no longer has to be chamfered. Thus, a substantially smooth surface of the anchor tool 1 is obtained when the anchor 6 is in a retracted position. As a result, dirt is no longer deposited and led into the space between the anchor 6 and the recess 5, and the known problems of the anchor 6 getting stuck are thus substantially reduced or eliminated.

Figure 4:
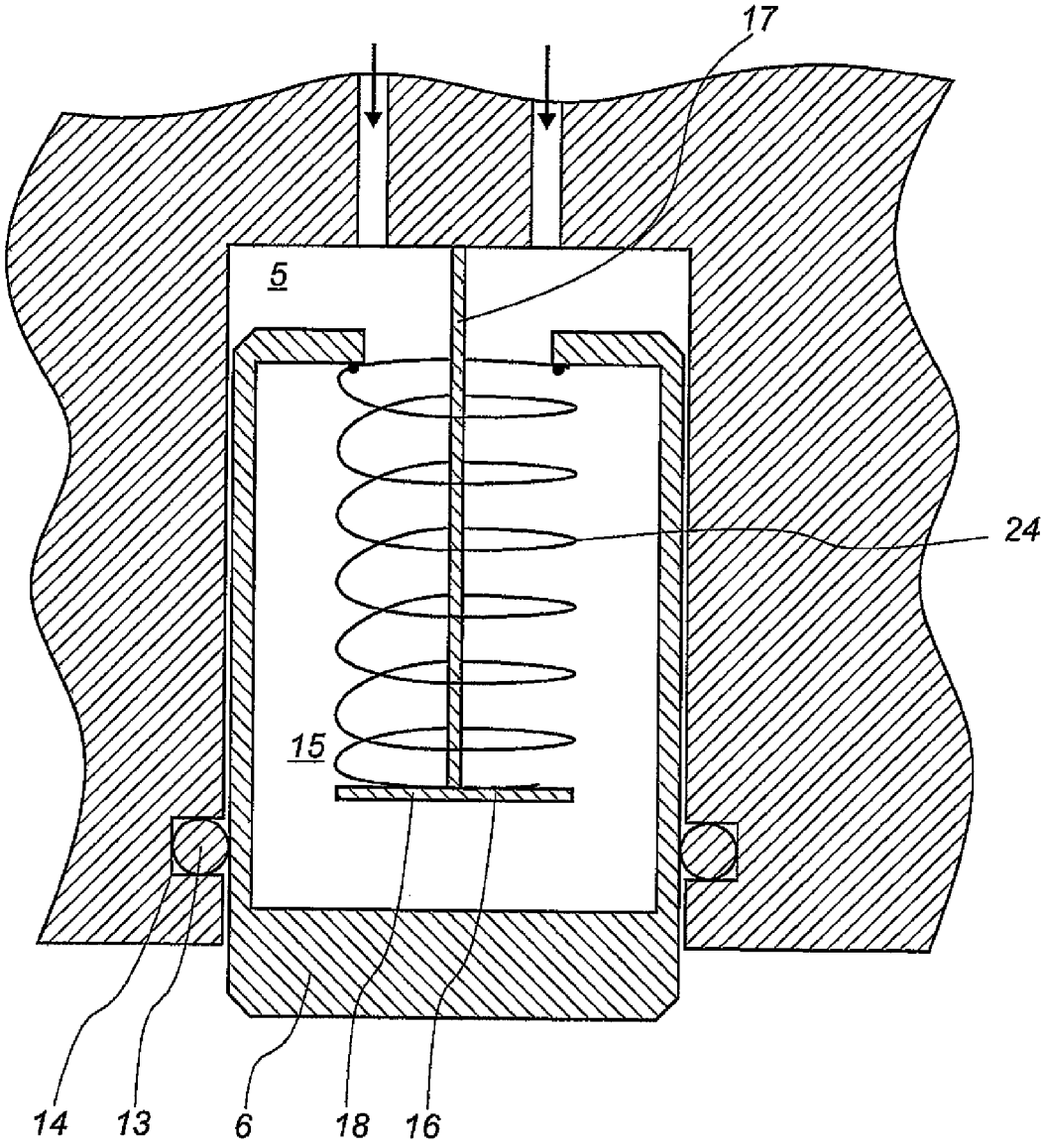
FIG. 4 shows a cross-sectional view of an anchor of the present invention.

When the anchor 6 is mounted in the recess 5, the seal ring 13 is squeezed between the groove 14 and the anchor 6 for sealing the bottom of the recess 5—as can be seen in FIG. 4. Fluid is pumped into the bottom of the recess 5, as illustrated by arrows in FIG. 4, for forcing the anchor 6 out of the recess 5 and for anchoring the tool 1 in its surroundings, e.g. the casing 2.

The anchor 6 has a cavity 15 and an opening at its end opposite the opening of the recess 5. Further, the anchor 6 has a retaining means 16. Part of the retaining means 16 is positioned in the cavity 15, and part of the retaining means 16 is positioned outside the anchor 6 in the recess 5. The retaining means 16 has the form of a rod 17 which is fastened to the bottom of the recess 5 and, at its other end, the retaining means 16 has a plate shaped means 18 which extends within the cavity 15 of the anchor 6. In this embodiment, the plate-shaped means 18 is in the form of a grid; however, in another embodiment, the plate-shaped means 18 may be a plate or a perforated plate.

A resilient means 24 is positioned in the cavity 15 between the opening of the cavity 15 and the plate means 18 of the retaining means 16. The resilient means 24 is here shown as a spring, but in another embodiment, it may be any kind of resilient means 24 which, when no longer compressed, is able to return to its un-compressed form, such as rubber, a disc spring, or the like.

When fluid is pumped into the recess 5 and the anchor 6 is forced outwards and anchors the tool 1 in its surroundings, the resilient means 24 is compressed. In the event that the anchor 6 is to be retracted into the recess 5 of the tool 1, the resilient means 24 will help retract the anchor 6 into the recess 5 due to the energy accumulated during compression.

The spring is designed to be sufficiently high to be able to retract the anchor 6 on its own without the help of a pump 7. In this way, the anchor tool 1 has a fail-safe construction enabling the anchors 6 to be retracted into the tool 1 if the wireline 9 is damaged and the tool 1 is no longer provided with power from above surface.

FIG. 4 shows fluid being pumped in through two openings in the bottom of the recess 5. In another embodiment, the fluid is pumped in through at least one opening in the side in the bottom of the recess 5. The fluid may be pumped into the recess 5 through only one opening or through a plurality of openings in the recess 5.

Figure 5:
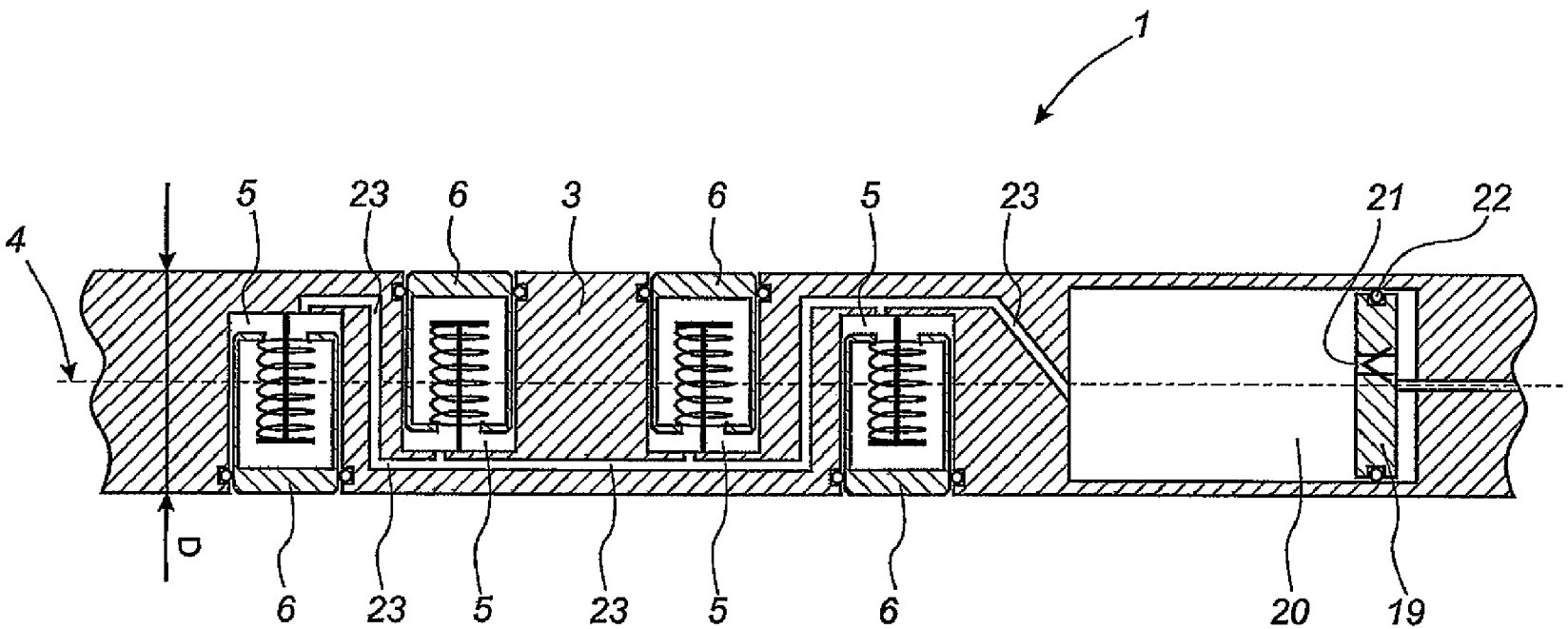
FIG. 5 shows a cross-sectional view of the anchor tool of FIG. 2.

As can be seen in FIG. 5, the anchors 6 are provided in the anchor tool 1 so that the anchors 6 extend partly through the tool body across a centre axis 4 of the tool 1. In this way, the anchors 6 can be made longer in relation to known anchors. By having anchors 6 with an extension transverse to the centre axis 4 of the tool 1, an extension which thus corresponds to more than half the diameter of the tool 1, the anchor 6 no longer tends to tilt substantially in the recess 5. As a consequence, the risk that the anchor 6 may get stuck in the recess 5 because the anchor 6 tilts too much during use of the tool 1 is substantially reduced.

In FIG. 5, the anchor 6 has an extension of at least ⅔ of the diameter D of the tool 1. In another embodiment, the extension of the anchor 6 is at least ⅘ of the diameter of the tool 1.

In FIGS. 1 and 5, the anchor tool is shown as having four anchors; however, in another embodiment, the anchor tool has more anchors. The additional anchors are also situated symmetrically.

Anchoring of the tool 1 is obtained by pumping fluid into the recesses 5 from which the anchors 6 project. The fluid is pumped via a duct 23 through openings in the bottom of the recess 5 by movement of a piston 19 in a piston housing 20. The fluid in the piston housing 20 is used to force the anchors 6 outwards and returns to the piston housing 20 when the anchors 6 are retracted into the recesses 5 again. The piston 19 is driven forward by a second pump 7, which again is driven by a motor 8. In another embodiment, the piston 19 is driven directly by the motor 8.

The piston 19 is provided with a pressure control valve 21 and, on its circumference, the piston 19 is provided with an O-ring 22 or the like sealing means.

In another embodiment, a spring means is positioned in the piston housing 20 in front of the piston 19 so that the spring means is compressed when fluid is pumped into the recesses 5 for forcing the anchors 6 outwards for anchoring the tool 1 to its surroundings. When the anchors 6 are retracted into the recesses 5, the spring means will assist the resilient means 24 in the cavity 15 of each anchor 6 in the retraction of the anchors 6. Thus, the above-mentioned fail-safe construction is substantially improved.

Figure 6:
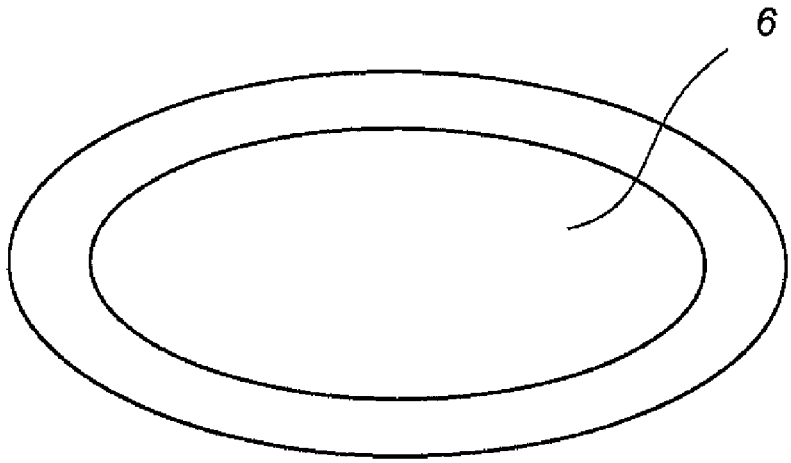
FIG. 6 shows an anchor of the present invention seen from the end abutting against the surroundings of the tool.
Figure 7:
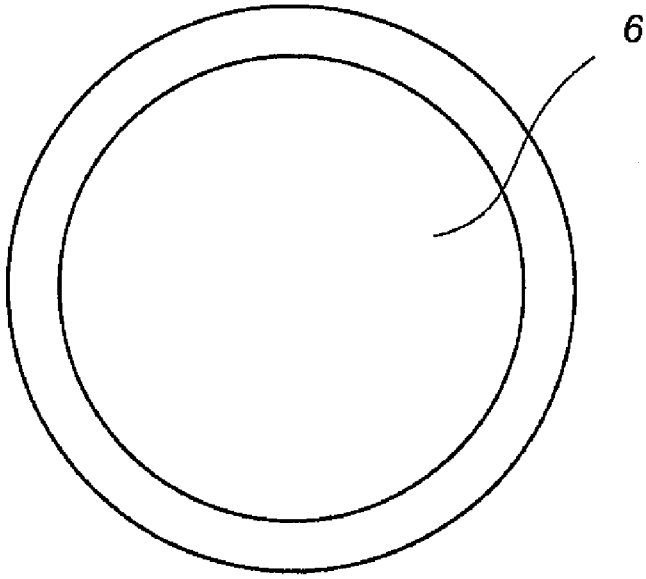
FIG. 7 shows another anchor of the present invention seen from the end abutting against the surroundings of the tool.

As shown in FIG. 6, the cross-section of the anchor 6 is oval or elliptic. In FIG. 7, the anchor 6 is shown having a circular cross-section. In other embodiments, the cross-section of the anchor 6 may be rectangular with two rounded ends positioned opposite one another.

In the event that the anchor tool 1 is not submergible all the way into the casing 2, a downhole tractor can be used to push the tool all the way into position in the well. A downhole tractor is any kind of driving tool capable of pushing or pulling tools in a well downhole, such as a Well Tractor®.

The invention claimed is:

1. Anchor tool for anchoring a downhole tool within a casing, a well, or any other downhole cavity, comprising:

a longitudinal tool body with a centre axis extending through the tool body in the centre of the body, a first recess, a second recess, a third recess, and a fourth recess in the tool body, and a first anchor, a second anchor, a third anchor, and a fourth anchor, where the first anchor is provided in the first recess, and so forth, and the anchors are outwards movable in the recesses for anchoring the tool, wherein each anchor provided in the recesses extends through the tool body transverse to and across the centre axis, and is mounted with the tool body in a non-rotational engagement, and wherein the anchors and the corresponding recesses are situated in the tool body for providing a symmetrical anchoring of the anchor tool as follows:

the first anchor is positioned in the first recess and so as to move across the centre axis and out in one direction orthogonal to the centre axis, the second anchor is positioned in the second recess next to the first recess and so as to move across the centre axis and out in a second direction opposite and parallel to the first direction, the third anchor is positioned in the third recess next to the second recess and so as to move in the second direction, and the fourth anchor is positioned in the fourth recess next to the third recess and so as to move in the first direction.

2. The anchor tool according to claim 1, wherein the anchor is movable by means of hydraulic.

3. The anchor tool according to claim 2, wherein hydraulic fluid is pumped into the recess for forcing the anchor to move out of the recess for anchoring the tool to its surroundings.

4. The anchor tool according to claim 3, wherein each anchor has a cavity with an opening and a retaining means fastened in the recess outside the anchor and extending through the opening into the cavity, and wherein a resilient means is provided within the cavity between an inside of the opening of the cavity and the retaining means and is compressed during movement of the anchor out of the recess.

5. The anchor tool according to claim 4, wherein the resilient means is positioned around the retaining means.

6. The anchor tool according to claim 4, wherein the retaining means has a rod extending though the resilient means, the rod at its one end being fastened to the recess and, at its other end, having a plate-shaped means for abutting against the resilient means.

7. The anchor tool according to claim 4, wherein the resilient means is a helically spring.

8. The anchor tool according to claim 1, wherein the recess on its inside is provided with a circumferential groove and at least one sealing means in the groove.

9. The anchor tool according to claim 1, wherein the anchor has an oval or elliptic cross-section.

10. The anchor tool according to claim 1, further comprising a pump system with a piston movable within a piston housing for pumping fluid into the recess.

* * * * *

UNITED STATES PATENT AND TRADEMARK OFFICE

CERTIFICATE OF CORRECTION

PATENT NO. : 8,230,914 B2
APPLICATION NO. : 12/596248
DATED : July 31, 2012
INVENTOR(S) : Jørgen Hallundbaek It is certified that error appears in the above-identified patent and that said Letters Patent is hereby corrected as shown below:

Title page, item (73) Assignee: should read as follows: Welltec A/S, Allerod (DK)

Signed and Sealed this
Twenty-third Day of October, 2012

David J. Kappos

David J. Kappos
*Director of the United States Patent and Trademark Office*